US006038855A

United States Patent [19]

Markström et al.

[11] Patent Number: 6,038,855

[45] Date of Patent: Mar. 21, 2000

[54] COLLECTOR DEVICE FOR THE PRIMARY PIPES OF AN EXHAUST MANIFOLD

[75] Inventors: Lars Markström, Göteborg; Lennarth Zander, Mölndal; Erik Olofsson; Olof Norblad, both of Göteborg, all of Sweden

[73] Assignee: AB Volvo, Sweden

[21] Appl. No.: 08/983,634

[22] PCT Filed: Jul. 19, 1996

[86] PCT No.: PCT/SE96/00962

§ 371 Date: Feb. 13, 1998

§ 102(e) Date: Feb. 13, 1998

[87] PCT Pub. No.: WO97/04222

PCT Pub. Date: Feb. 6, 1997

[30] Foreign Application Priority Data

Jul. 21, 1995 [SE] Sweden ..... 9502554

[51] Int. Cl.[7] ..... F01N 7/10

[52] U.S. Cl. ..... 60/323; 60/313

[58] Field of Search ..... 60/313, 312, 323; 285/131

[56] References Cited

U.S. PATENT DOCUMENTS

| | | | |
|---|---|---|---|
| 3,453,824 | 7/1969 | Biesecker | 60/323 |
| 3,491,534 | 1/1970 | Garner | 60/323 |
| 4,188,784 | 2/1980 | Hall | 60/323 |
| 4,621,494 | 11/1986 | Fujita . | |
| 4,796,426 | 1/1989 | Feuling . | |
| 5,216,883 | 6/1993 | Flugger | 60/313 |

FOREIGN PATENT DOCUMENTS

| | | | |
|---|---|---|---|
| 2 378 178 | 8/1978 | France . | |
| 1 476 573 | 3/1970 | Germany . | |
| 36 03 868 A1 | 8/1987 | Germany . | |
| 3603868 | 9/1987 | Germany | 60/323 |

*Primary Examiner*—Thomas E. Denion
*Attorney, Agent, or Firm*—Lerner, David, Littenberg, Krumholz & Mentlik, LLP

[57] ABSTRACT

A collector is disclosed for the primary pipes of an exhaust manifold in an internal combustion engine. The collector includes a common cavity and a plurality of primary pipes having a first cross-sectional area at their outlet ends and second cross-sectional area at an upstream location, the first cross-sectional area being less than the second cross-sectional area, with the primary pipes being in direct contact with the common cavity of the collector and further arranged to include a single central pipe with the remainder of the pipes spaced around the central pipe, with the outlet of the central pipe being formed as a conically tapering portion and the outer wall of the central pipe forming part of the inner wall of the remainder of the pipe.

8 Claims, 3 Drawing Sheets

COLLECTOR DEVICE FOR THE PRIMARY PIPES OF AN EXHAUST MANIFOLD

FIELD OF THE INVENTION

The present invention relates to a collector for the primary pipes of an exhaust manifold of an internal combustion engine.

More particularly, the present invention relates to collectors for five-cylinder engines of turbocharged and normally-aspirated types.

BACKGROUND OF THE INVENTION

A collector for the primary pipes of an exhaust manifold of an internal combustion engine is known from French Patent No. 2,378,178.

It is common practice to connect the exhaust ports of a multi-cylinder internal combustion engine of light vehicles to a single exhaust system. This occurs by use of an exhaust manifold which is a single unit fitted to the face of the cylinder head comprising the exhaust ports. The exhaust manifold is normally a casting having a plurality of primary exhaust pipes each feeding into a connection point, for example through a grouping device which first groups together pairs of primary pipes. The grouping device then leads, by means of a single pipe, to a further grouping device and then into the exhaust pipe, possibly through a turbocharger. Such grouping devices are normally manufactured as castings.

These types of arrangements, particularly on five-cylinder engines, have proven to be difficult to design in a compact manner, unless pipe paths with reduced efficiency are adopted. Additionally, a further problem which is encountered when trying to group all of the primary pipes in a compact fashion is that of protecting each of the exhaust ports of the engine against compression waves from neighboring exhaust ports. This problem is worsened when the primary pipes have to be short, which would typically be the case for example when a turbocharger is fitted, or when a catalytic converter has to be located relatively close to the engine.

An object of the present invention is thus to provide a solution to the aforementioned problems such that a space-saving and yet efficient device can be achieved. In particular, the solution should be one which does not reduce performance characteristics of an engine to which the collector of the invention is fitted, and should even provide increased performance.

SUMMARY OF THE INVENTION

In accordance with the present invention, this and other objects have now been realized by the invention of a collector for the primary pipes of an exhaust manifold of an internal combustion engine, the primary pipes leading exhaust gases directly from the cylinders of the engine, the collector comprising a common cavity and a plurality of the primary pipes, each of the plurality of primary pipes including an inlet end and an outlet end, the outlet ends of each of the primary pipes including an inner wall and outer wall and having a first cross-sectional area and an upstream location of the primary pipes having a second cross-sectional area, the first cross-sectional area being less than the second cross-sectional area, the outlet ends of the primary pipes being in direct contact with the common cavity of the collector, the plurality of pipes further arranged to include a single central pipe and the remainder of the plurality of pipes being spaced around the central pipe, the outlet end of the central pipe being formed substantially as a conically tapering portion, and the outer wall of the central pipe forming part of the inner wall of each of the remainder of the pipes.

In accordance with one embodiment of the collector of the present invention, each of the plurality of pipes is directed parallel to others of the plurality of pipes at its intersection with the common cavity, so as to allow substantially axial flow into the common cavity.

In accordance with another embodiment of the collector of the present invention, the cavity has a circular cross-section.

In accordance with another embodiment of the collector of the present invention, each of the plurality of pipes has a substantially constant cross-sectional area along at least 60% of its length, and preferably along at least 80% or more of its length.

In accordance with another embodiment of the collector of the present invention, each of the plurality of pipes is made from steel tubing.

In accordance with another embodiment of the collector of the present invention, each of the plurality of pipes has a gradually reducing cross-sectional area at its end region.

In accordance with another embodiment of the collector of the present invention, the number of the plurality of pipes is five, and the end of the central pipe projects outwardly beyond the end of the remainder of the plurality of pipes.

With the collector according to the present invention, the ends of all the primary pipes have a reduced cross-sectional area feeding into a common cavity. This induces a pulse conversion effect, whereby the disadvantageous compression wave effects on other exhaust ports are greatly reduced or even eliminated. At the same time, a compact arrangement is achieved in an efficient manner.

BRIEF DESCRIPTION OF THE DRAWINGS

The present invention will now be described in more detail with reference to the following detailed description, which refers to the accompanying drawings, in which.

DETAILED DESCRIPTION

Figure 1:
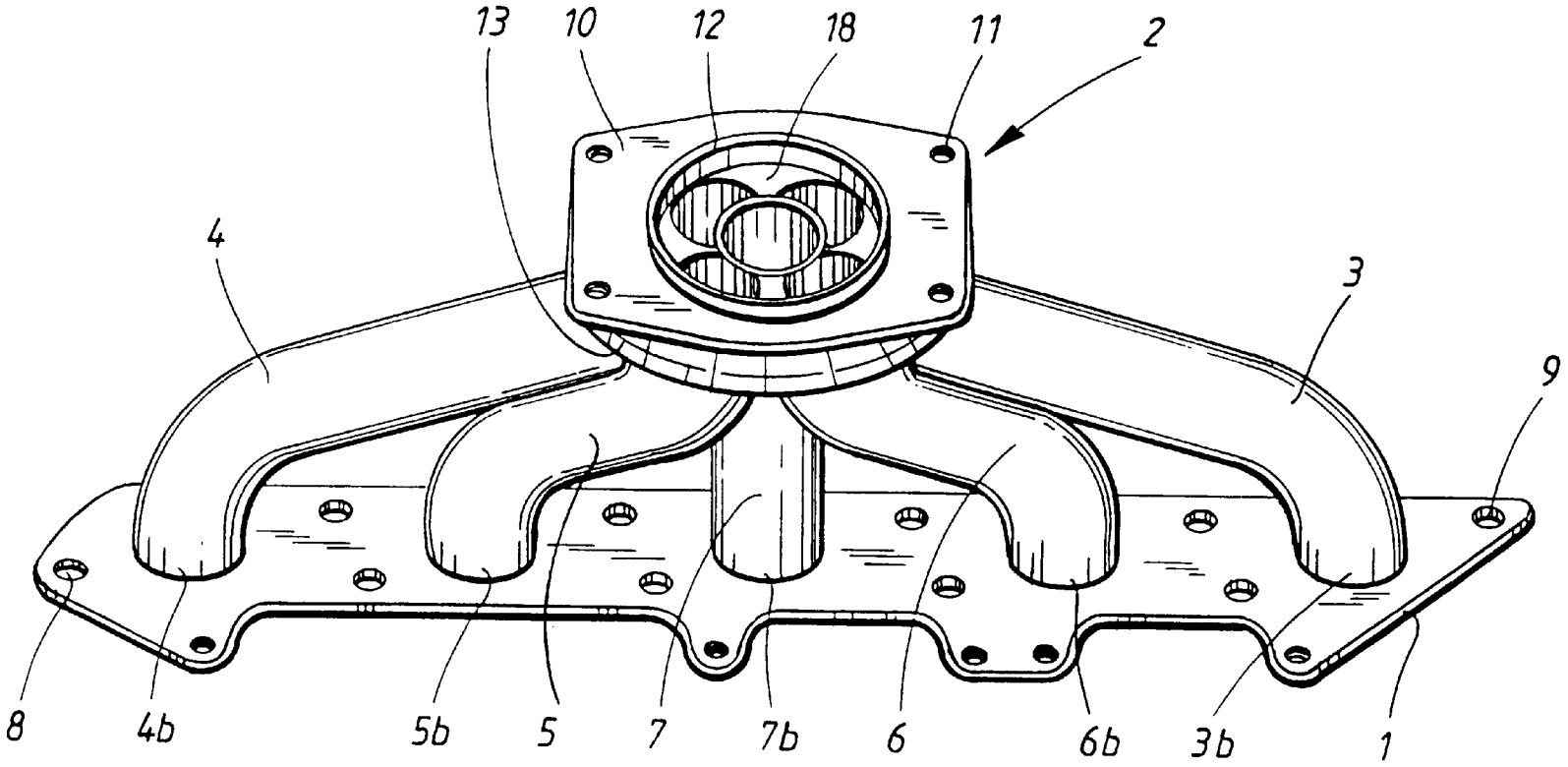
FIG. 1 is a front, perspective view showing a collector according to the present invention.

Referring to the drawings, in which like reference numerals refer to like elements thereof, FIG. 1 depicts a collector of the present invention denoted generally by reference numeral 2. The collector arrangement is connected to a flange I which, together with the pipes 3–7 welded thereto, forms an exhaust manifold for connection to the engine cylinder head. Attachment means in the form of attachment openings, e.g. 8 and 9, for the passage of bolts (not shown) are provided in the flange 1.

As can be seen, the flange 1 is provided with five separate primary pipes 3, 4, 5, 6 and 7 and is thus adapted for use with a five-cylinder engine (not shown). Each of pipes 3–7 has an inlet end denoted with the suffix "b," as 3*b*, 4*b*, 5*b*, 6*b* and 7*b*, and an outlet end (see FIG. 2) denoted similarly with the suffix "a". Each of the pipes 3–7 is preferably made of steel tubing and has a substantially constant, circular cross-section over the majority of its length (e.g. more than 60%, preferably more than 80% of the pipe length). However, each of the outlet ends 3*a*–7*a* has a reduced cross-sectional area with respect to the substantially constant cross-section of the majority of the pipe. Additionally, the inlet end of the pipes 3*b*–7*b* may also be deformed into a more oval-type shape (not shown) so that it better conforms to the shape of the exhaust ports on the engine and flange 1.

The substantially constant cross-section and gently curving primary pipe runs of pipes 3–7 will provide smooth gas flow from the exhaust port all the way to the outlets.

Each of the primary pipes 3–7 is collected together at its outlet end 3*a*–7*a* in a collector arrangement 2 which will be described in more detail with respect to FIG. 5. The connector arrangement as shown in FIG. 1 is preferably provided with an attachment flange 10 with threaded attachment holes 11 for attachment to, for example, a turbocharger (not shown). Alternatively, the flange 10 may be connected directly to an exhaust pipe (not shown).

Figure 5:
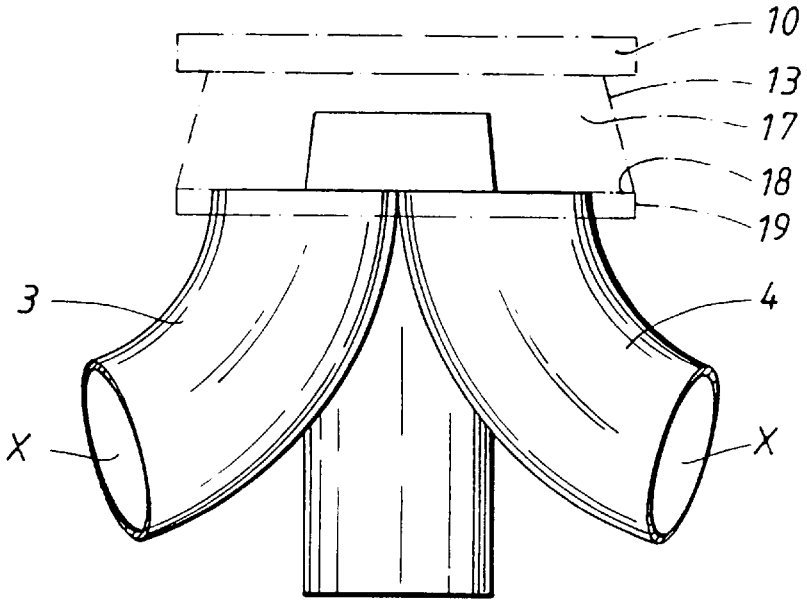
FIG. 5 is a side, plan view of the collector portion shown in FIG. 2, with the common cavity and connection flange added in dashed lines.

Between the pipe outlets 3*a*–7*a* and the flange 10 is a cavity 17 (see FIG. 5). The cavity is formed, in this embodiment, by a conically sloping outer wall 13 of thin steel joined to the flange 10 at one end, and to the base 18 at the other. Each of the pipe outlets 3*a*–7*a* thus feeds directly into this cavity 17, the cavity thus forming a common cavity for ail the pipe outlets.

In order for the exhaust gases to reach the turbocharger or the like, a circular aperture 12 is provided in the flange 10, through which the outlet ends 3*a*–7*a* of the primary pipes 3–7 and the upper surface is of base 19 (see also FIG. 5) are partly visible.

Figure 2:
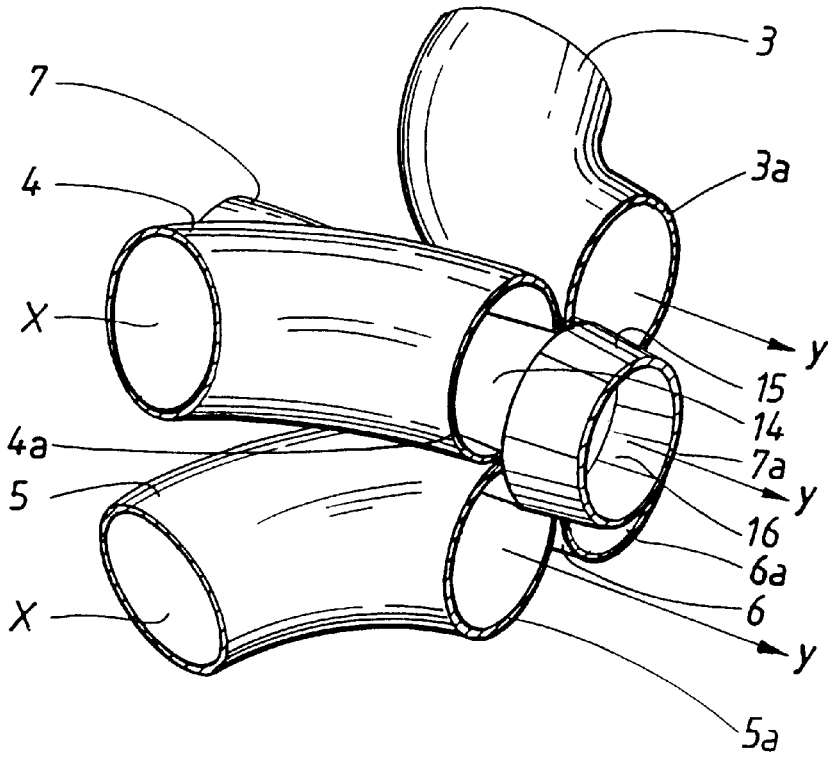
FIG. 2 is a side, perspective view of a portion of the collector shown in FIG. 1, in which the cavity housing of the collector has been removed.
Figure 3:
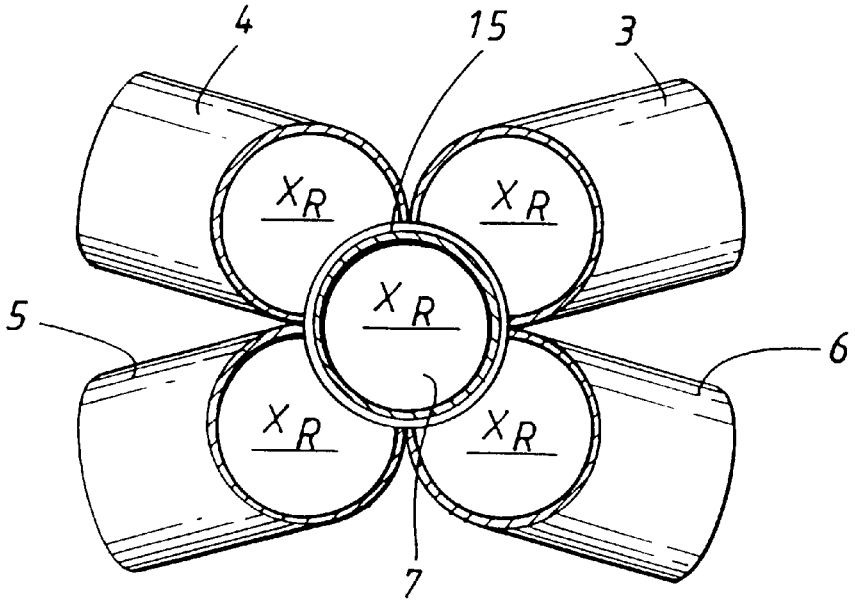
FIG. 3 is a front end, elevational view of the collector portion shown in FIG. 2.
Figure 4:
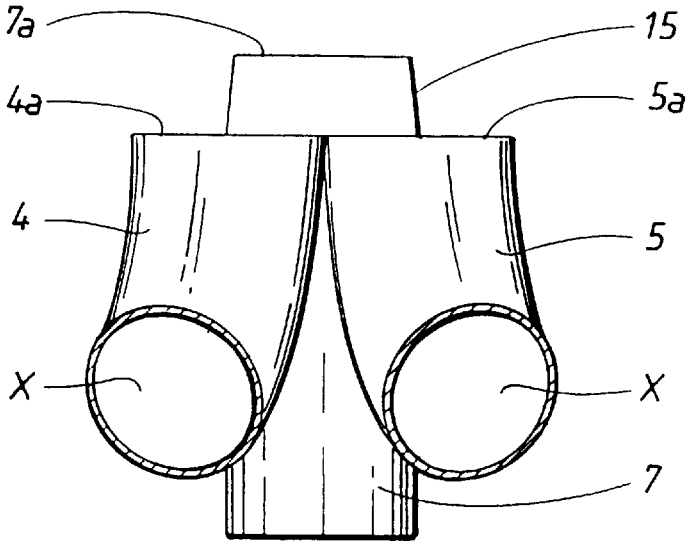
FIG. 4 is a side, elevational view of the collector portion shown in FIG. 2.

FIGS. 2 to 4 show a partial view of the arrangement of FIG. 1, whereby the conical housing 13, the flange 10 and the base 18 of the collector housing have been removed for reasons of clarity.

As can be seen in FIG. 2, each of the pipes 3–7 is smoothly curved and the pipe ends 3*a* to 7*a* are clearly visible. In this embodiment the outlet end 7*a* of pipe 7 projects forwardly beyond the remainder of the pipe ends. This projecting relationship is not a requirement, but it has been found that it is desirable to have a minimum primary pipe length, in particular with five-cylinder arrangements. Thus, due to the placement of the pipe and the need to keep the overall width of the arrangement as small as possible, the pipe 7 extends a short distance (e. g. 1 cm or so) beyond the ends of the others.

The central pipe 7 may be straight but, in the embodiment shown, has a small curvature close to its inlet end 7*b*. The outlet end 7*a* of the pipe 7 is however directed so that the gas flow out of it and the gas flow out of its neighboring outlet pipe ends 3*a*–6*a* will be substantially parallel with one another (see arrows "y" in FIG. 2).

In order to produce a compact arrangement, the pipe 7 has been left substantially unaltered, whilst the pipes 3 to 6 have been cut away at their radially inner sides and welded to the exterior of pipe 7. Thus, in FIG. 2, the exterior surface 14 of pipe 7 is visible inside the pipe 4 and thus forms part of the internal wall of pipe 4. This is similarly the case for pipes 3, 5 and 6.

As is clear from FIG. 3, this compact connection of the pipes produces, at the same time, a required reduction in the cross-sectional area of each of the pipes 3 to 6 compared to the cross-sectional area of the main part of their length. Thus the cross-sectional area of the majority of the pipe length-of pipes 3–6 is shown as "X", whereas the reduced area in FIG. 3 is shown as "XR", where XR<X' The reduction in area should not be too great such that a severe restriction of flow through the outlet occurs, but at the same time the restriction must be sufficient to provide a pulse conversion effect so that the pressure waves of one cylinder do not negatively affect the gas flows of other cylinders. The optimal area reduction for any particular engine can be determined by the skilled man by simple trial and error. In the arrangement shown, the area reduction is of the order of 5–10% of "x".

Since the cross-sectional area of the central primary pipe 7 is not reduced by the connection with the other pipes per se, the area is reduced by forming a slight conical taper 15 at the end of the pipe. The conical taper as depicted thus has inner and outer surfaces 16 and 15 respectively which are both tapered. The outlet end 7*a* of the tapered portion thus also has an area of substantially XR (see also FIG. 3) and the pipe is directed such that flow direction "y" will be substantially parallel to the flow direction in the remained of the pipes 3–6.

It is however not a requirement that a projecting portion is added to, or formed on the end of, the pipe 7, since other means of producing a reduced cross-sectional area of the pipe end are also possible which will allow the end 7*a* of pipe 7 to be flush with the other pipe ends 3*a*–6*a*.

FIG. 4 shows a side view of the arrangement in FIG. 2, whereby it can be seen that the ends 4*a* and 5*a* of pipes 4 and 5 lie substantially in the same plane. The pipes 3 and 6 are not visible in the Figure as they are hidden by the pipes 4 and 5, but these pipes too will have their ends 3*a* and 6*a* substantially flush with ends 4*a* and 5*a*.

FIG. 5 shows a plan view of the arrangement in FIG. 2, whereby the housing or body of the collector arrangement, denoted generally as 2 in FIG. 1, has been depicted in dashed lines. A truncated conical cavity 17 having an outer wall 13 is formed between the exhaust pipe/turbocharger connection flange 10 and a base flange 19. Each of the pipe ends 3*a* to 7*a* thus feeds directly into the cavity 17 without intermediary arrangements. The base flange 19 is preferably circular and suitably has five holes placed therein for connection of the pipe ends 3*a* to 6*a* such that these will be substantially flush with the surface 18 of the base flange 19. For manufacture, this base flange 19 may be simply positioned over the five pipes 3–7 such that the upper ends are substantially flush with the surface 18. The arrangement can then be welded.

The distance between the inner surfaces of flanges 10 and 19 is kept as small as possible in order to allow as much space as possible behind the collector so that easy access to, and sufficient space for, the exhaust system and/or turbocharger is provided. The distance depends to a large extent an the size of the turbine inlet, or where no turbocharger is fitted, on the size of the exhaust pipe inlet. It is thus possible that if the turbocharger inlet is the same size as that of the grouped primary pipe ends, the common cavity can then be formed by the turbocharger inlet.

The entire arrangement is preferably made from steel tubing and all connections are preferably welded connections, such that the unit is relatively lightweight compared to conventional cast manifold systems. However, the unit may also be formed as a cast unit.

By use of the aforegoing collector arrangement on a current Volvo, five-cylinder, 2.3 liter, turbocharged sparkignition engine, it has been found that not only is performance not impaired, but an increase of maximum power of some 7–9 kW can be obtained (during laboratory testing). A general increase over the whole power curve and of course torque curve is also produced. This is accounted for, to a large extent, by the increase in volumetric efficiency obtained from the arrangement in comparison to the standard arrangement.

Additionally, if the pipes 3–7 are made with lightweight steel tubing and welded connections, the catalytic light-off time of a standard catalytic converter (i.e. one without an afterburner arrangement or the like) fitted to the engine can be reduced by some 15 seconds.

Whilst the invention has been described only with reference to certain embodiments, it should be understood that the scope of the invention is not limited to said embodiments and that many variations of the invention are encompassed within the scope of the appended claims.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A collector for the primary pipes of an exhaust manifold of an internal combustion engine, said primary pipes leading exhaust gases directly from the cylinders of said engine, said collector comprising a common cavity and a plurality of said primary pipes, each of said plurality of primary pipes including an inlet end and an outlet end, said outlet ends of each of said primary pipes including an inner wall and an outer wall and having a first cross-sectional area and an upstream location of said primary pipes having a second cross-sectional area, said first cross-sectional area being less than said second cross-sectional area, said outlet ends of said primary pipes being in direct contact with said common cavity of said collector, said plurality of pipes further arranged to include a single central pipe, and the remainder of said plurality of pipes being spaced around said central pipe, said outlet end of said central pipe being formed substantially as a conically tapering portion, and said outer wall of said central pipe forming part of said inner wall of each of said remainder of said pipes.

2. The collector according to claim 1, wherein each of said plurality of pipes is directed parallel to others of said plurality of pipes at its intersection with said common cavity, so as to allow substantially axial flow into said common cavity.

3. The collector according to claim 1 or claim 2, wherein said cavity has a circular cross-section.

4. The collector according to claim 1, wherein each of said plurality of pipes has a substantially constant cross-sectional area along at least 60% of its length.

5. The collector according to claim 1, wherein each of said plurality of pipes is made from steel tubing.

6. The collector according to claim 1, wherein each of said plurality of pipes has a gradually reducing cross-sectional area at its end region.

7. The collector according to claim 1, wherein the number of said plurality of pipes is five, and the end of said central pipe projects outwardly beyond the end of said remainder of said plurality of pipes.

8. The collector according to claim 4 wherein each of said plurality of pipes has a substantially constant cross-sectional area along at least 80% of its length.

* * * * *

UNITED STATES PATENT AND TRADEMARK OFFICE

CERTIFICATE OF CORRECTION

PATENT NO. : 6,038,855

DATED : March 21, 2000

INVENTOR(S) : Markström et al.

It is certified that error appears in the above-indentified patent and that said Letters Patent is hereby corrected as shown below:

Col. 2, line 61, "I" should read --1--.

Col. 3, line 32, "ail" should read -all--.

Col. 3, line 36, "is" should read --18--.

Col. 4, line 5, "X' " should read --X.--

Col. 4, line 22, "remained" should read --remainder--.

Col. 4, line 56, "an" should read --on--.

Signed and Sealed this

Tenth Day of April, 2001

*Attest:*

Nicholas P. Godici

NICHOLAS P. GODICI

*Attesting Officer*

*Acting Director of the United States Patent and Trademark Office*